US006991482B1

(12) United States Patent
Liao

(10) Patent No.: US 6,991,482 B1
(45) Date of Patent: Jan. 31, 2006

(54) POWER PLUG

(76) Inventor: Sheng Hsin Liao, No. 10, Alley 38, Lane 229, San Chun St., Shulin City, Taipei Hsien (TW)

( * ) Notice: Subject to any disclaimer, the term of this patent is extended or adjusted under 35 U.S.C. 154(b) by 0 days.

(21) Appl. No.: 10/912,196

(22) Filed: Aug. 6, 2004

(51) Int. Cl.
*H01R 29/00* (2006.01)

(52) U.S. Cl. ..... 439/166; 439/171; 439/106; 439/222; 439/653

(58) Field of Classification Search ..... 439/171–173, 439/106, 222, 653
See application file for complete search history.

(56) References Cited

U.S. PATENT DOCUMENTS 6,030,241 A * 2/2000 Chiba ..... 439/222
6,227,888 B1 * 5/2001 Hahn ..... 439/173
6,328,581 B1 * 12/2001 Lee et al. ..... 439/106

* cited by examiner

*Primary Examiner*—Truc Nguyen
(74) *Attorney, Agent, or Firm*—Rosenberg, Klein & Lee

(57) ABSTRACT

A power plug includes a connected unit, an assembled unit and a clamping mechanism. The connected unit has an insulative housing with a terminal open, and the insulative housing has a conductive terminal disposed therein. The assembled unit has an insulative casing and a movable body movably received in the insulative casing. The movable body has a first conductive pole and a second conductive pole. The assembled unit is installed in the terminal open of the connected unit. One of the first conductive pole and the second conductive pole is electrically connected to the conductive terminal, and another of the first conductive pole and the second conductive pole is projected outside the insulative casing. The clamping mechanism is disposed between the connected unit and the assembled unit.

15 Claims, 8 Drawing Sheets

POWER PLUG

BACKGROUND OF THE INVENTION

1. Field of the Invention

The present invention relates to a power plug, and especially to a power plug having a variable conductive pole set assembled thereon.

2. Description of the Related

Because power sockets are not designed in the same way in every country, the shape of the power plug and the type of power plugs are also different. The shape of the power plug may be a straight shape or a columnar shape. The type of the power plug may be two conductive poles type or three conductive poles type (using two conductive poles and a grounding pole). Therefore, users must take a transformer assembly container for using products from their home country when traveling to a foreign country. The transformer assembly container has a transformer and all the different kinds of power plugs used throughout the world. However, it is inconvenient for users to choose which one of the power plugs to use. Also the user will worry about losing or misplacing the power plugs.

Employing unique perspectives and applications of theories, and based upon several years experience in specialized production of flexible assembly systems and mechanisms, the inventor has come up with an innovative power plug.

SUMMARY OF THE INVENTION

The primary object of the present invention is to provide a power plug, which includes a variable conductive pole set. The variable conductive pole set has two conductive poles or three conductive poles (one of the three conductive poles is a grounding pole that can be in use or not in use). The shape of the conductive pole is changeable so either a straight shape or a columnar shape can be used.

In order to achieve the above objects, the present invention provides a power plug comprising a connected unit, an assembled unit and a clamping mechanism.

The connected unit has an insulative housing with a terminal open. The insulative housing has a conductive terminal disposed therein.

The assembled unit has an insulative casing and a movable body movably received in the insulative casing. The insulative casing slides so that the plug at either end can be used. The movable body has a first conductive pole and a second conductive pole. The assembled unit is installed in the terminal open of the connected unit. One of the first conductive poles and the second conductive pole are electrically connected to the conductive terminal. Another of the first conductive poles and the second conductive pole are projected outside the insulative casing.

The clamping mechanism is disposed between the connected unit and the assembled unit.

It is to be understood that both the foregoing general description and the following detailed description are exemplary, and are intended to provide further explanation of the invention as claimed. Other advantages and features of the invention will be apparent from the following description, drawings and claims.

BRIEF DESCRIPTION OF THE DRAWINGS

The various objects and advantages of the present invention will be more readily understood from the following detailed description when read in conjunction with the appended drawing, in which.

DETAILED DESCRIPTION OF PREFERRED EMBODIMENTS

Figure 1:
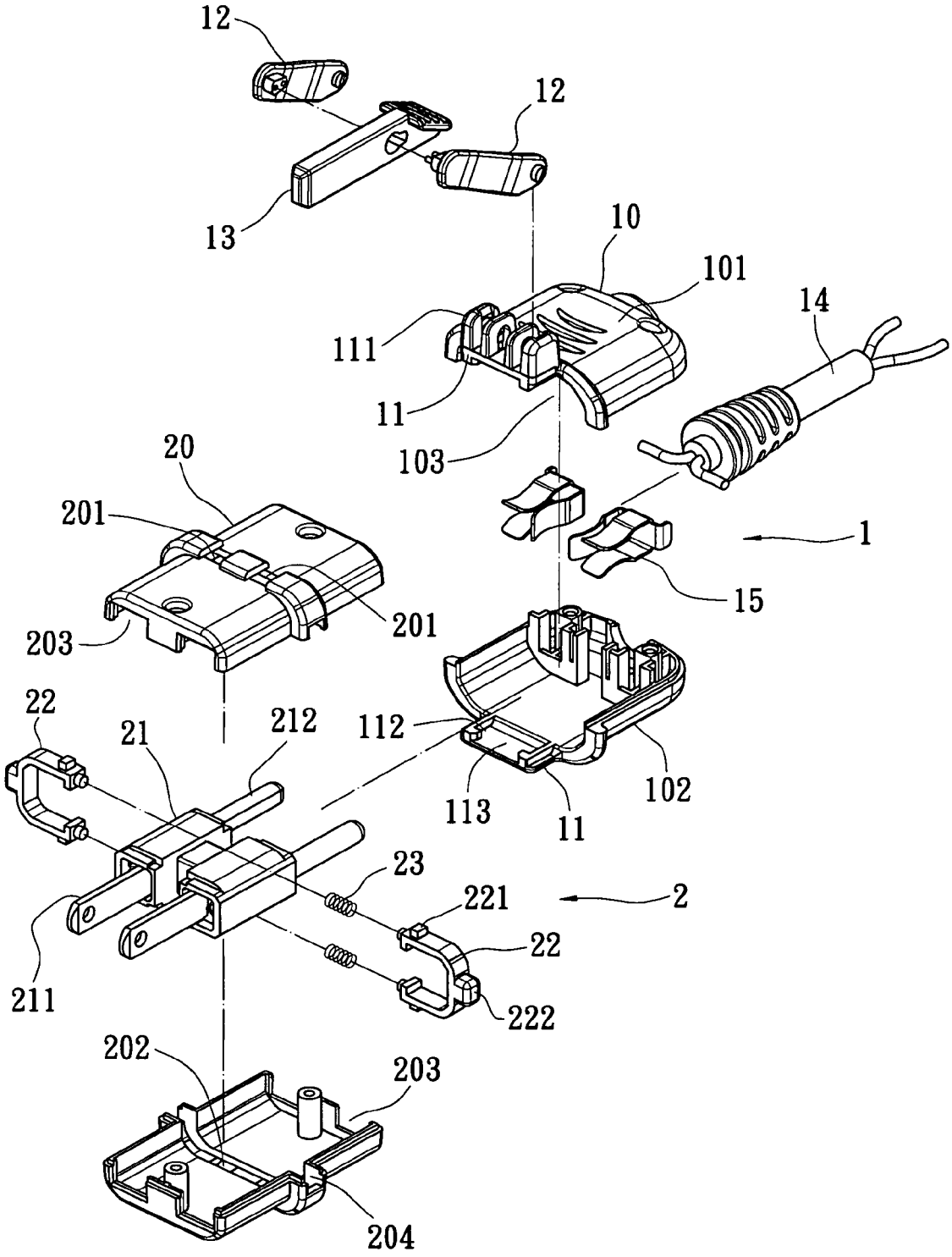
FIG. 1 is an exploded view of the power plug of the present invention.
Figure 2:
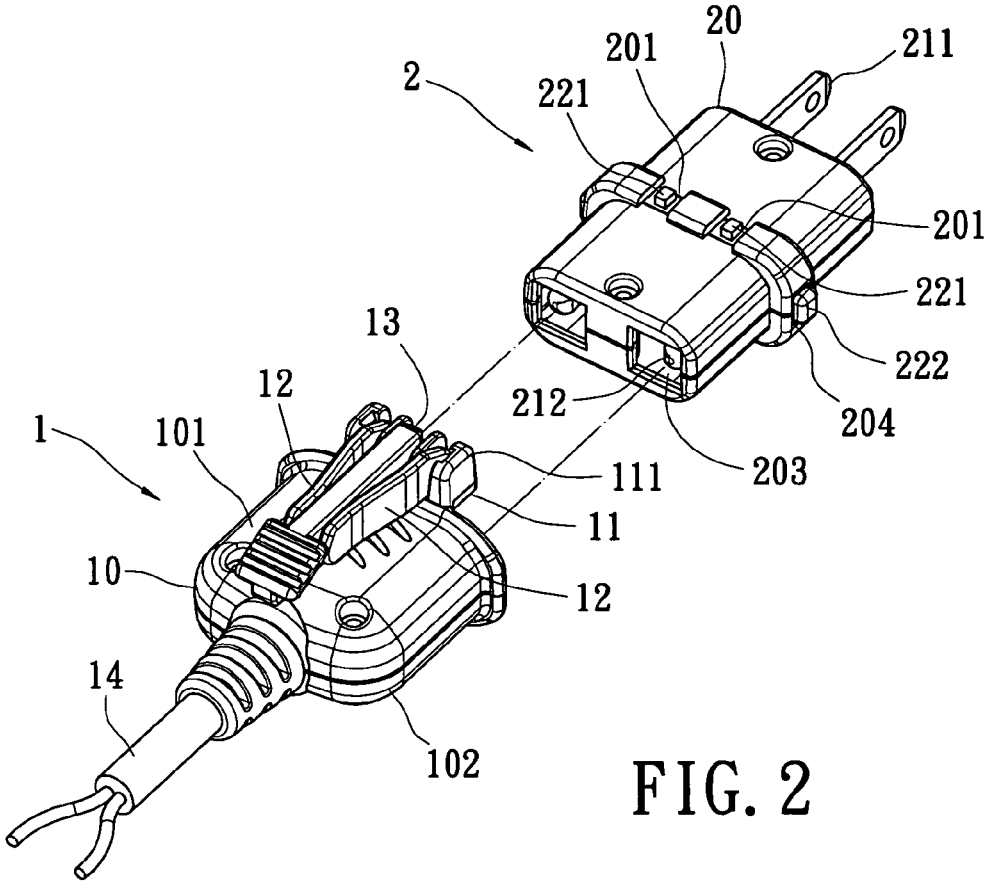
FIG. 2 is a partial exploded view of the power plug of the present invention.
Figure 3:
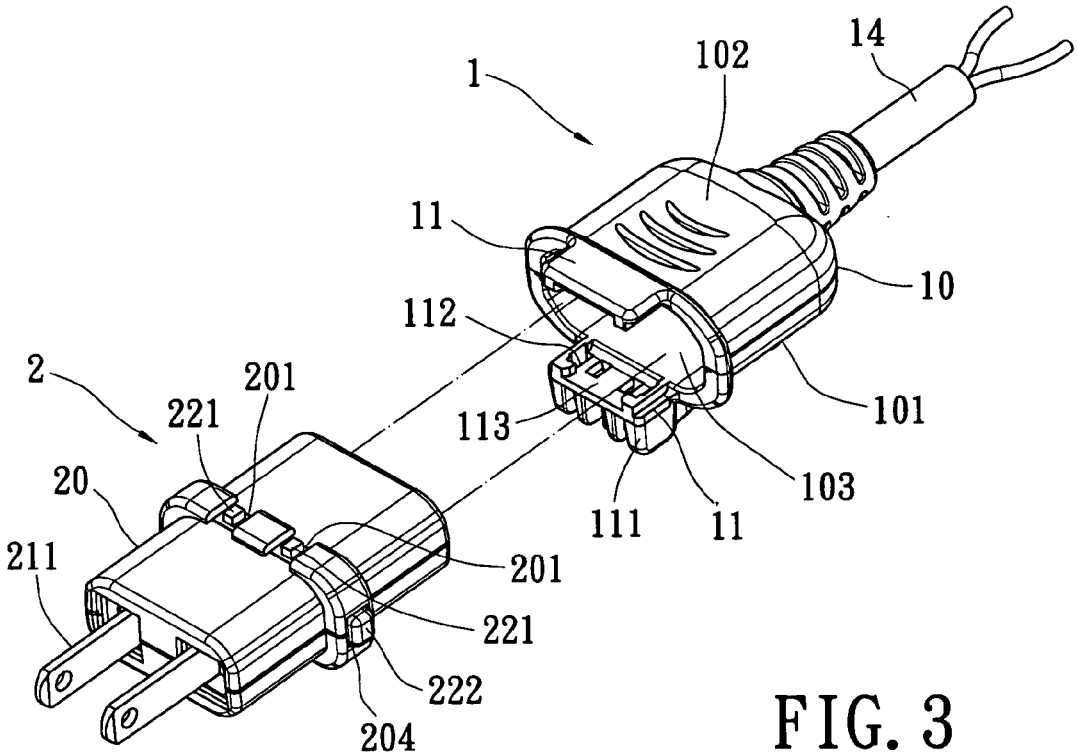
FIG. 3 is an inverse partial exploded view according to FIG. 2 of the power plug of the present invention.

Referring to FIGS. 1 to 7, the present invention provides a power plug, which comprises a connected unit 1, an assembled unit 2 and a clamping mechanism 3. The connected unit 2 with a casing is connected with a power supply set 14. The assembled unit 2 is received in the connected unit 1 and has a pair of movable conductive poles therein. The clamping mechanism 3 has a pair of clamping grooves 112 formed on the connected unit 1 and a pair of clamping elements 22 disposed on the assembled unit 2.

The connected unit 1 includes an insulative housing 10 composed of a top housing 101 and a bottom housing 102. The insulative housing 10 has a terminal open 103 formed at a front side thereof, a pair of projected bodies 11 projected forwardly symmetrically from a top side and a bottom side thereof. The pair of clamping grooves 112 with two notches 113 respectively formed on the pair of projected bodies 11. The connected unit 1 includes a pair of conductive terminals 15 with a clamping capability received in the insulative housing 10 and connected to the power wire set 14 that is disposed outside the insulative housing 10. One of the projected bodies 11 has two pivoted seats 111. The connected unit 1 further includes a grounding pole 13, and two rotatable elements 12 respectively pivoted between one of the two pivoted seats 111 and the grounding pole 13 for the grounding pole 13 rotating relative to the two rotatable elements 12.

The assembled unit 2 includes an insulative casing 20, which is composed of two mating cases, and a movable element 21 received in the insulative casing 20. The insulative casing 20 has two openings 201 formed at each of a top side and a bottom side thereof, two holes 203 formed at each of a front side and a rear side thereof, two through holes 204 respectively formed at two lateral sides thereof, and a guiding groove 202 formed around an inner wall thereof and through each of the openings 201 and the through holes 204. The movable element 21 has a pair of first conductive poles 211 projected at one side of the isolative casing 20 and a pair of second conductive poles 212 projected at another side of the isolative casing 20. The pair of first conductive poles 211 with a straight shape and the pair of second conductive poles 212 with a columnar shape are electrically connected to each other. The movable element 21 is received in the insulative casing 20 to make the pair of the first conductive poles 211 and the pair of the second conductive poles 212 to dispose through the corresponding the holes 203.

Figure 5:
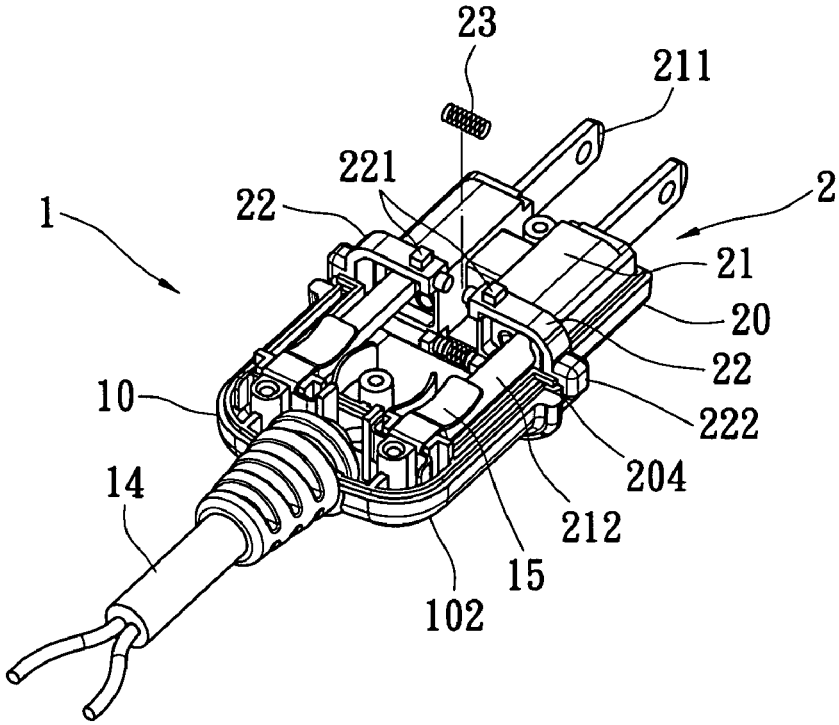
FIG. 5 is a perspective view of when the top housing of the insulative housing and the top casing of the insulative casing are detached from the insulative housing and the insulative casing according to the power plug of the present invention.

The pair of clamping elements 22 mate with each other to form a circuit shape for embedding into the guiding groove 202 of the insulative casing 20. Two elastic elements 23 are disposed between the pair of clamping elements 22 for holding open the pair of clamping elements 22. Each of the two clamping elements 22 has two clamping bodies 221 respectively disposed at a top side and a bottom side thereof. Each of the two clamping bodies 221 is inserted into the corresponding opening 201 of the insulative casing 20. Each of the two clamping elements 22 has a button body 222 projected from an outside thereof. Each of the two button bodies 222 is disposed through the corresponding through hole 204 of the insulative casing 20. Each of the two clamping elements 22 has an inner wall used to position the pair of first conductive poles 211 or the pair of second conductive poles 212 in a protrusion state from the isolative casing 20 (as shown in FIG. 5).

When the user presses the two opposite button bodies 222 of the clamping element 22 to compress the two elastic elements 23, the two clamping elements 22 will approach each other along the guiding groove 202 allowing the movable body 21 to move. At the same time, the user can choose the pair of first conductive poles 211 or the pair of second conductive poles 212 to project from one side of the insulative casing 20.

Figure 4:
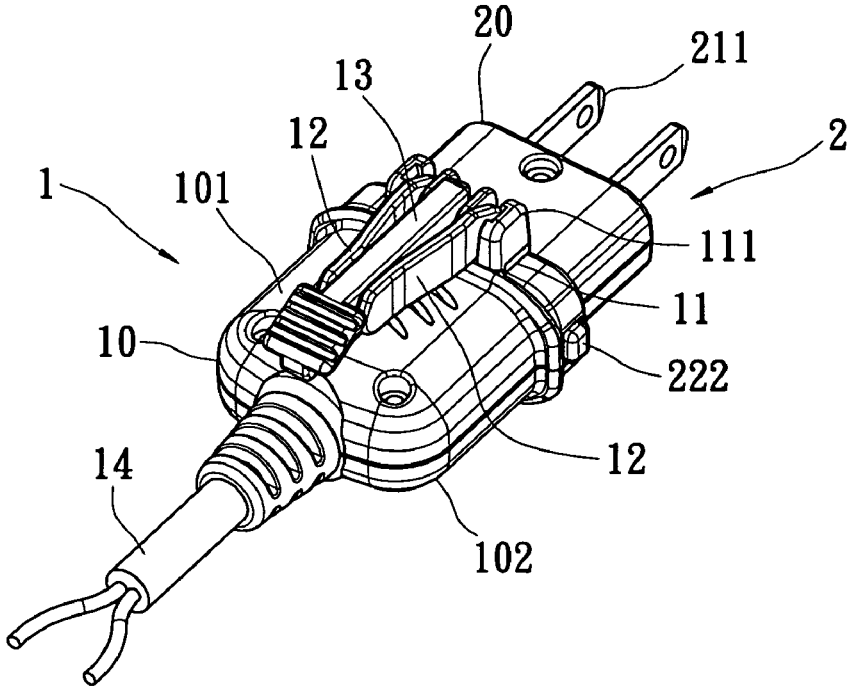
FIG. 4 is an assembled view according to the FIG. 2 of the power plug of the present invention.

Furthermore, another side of the insulative casing 20 is inserted into the terminal open 103 of the connected unit 1. When the insulative casing 20 of the assembled unit 2 is inserted into the insulative housing 10 of the connected unit 1, the clamping bodies 221 pass through the notch 113 and are retained in the clamping grooves 112 (as shown in FIG. 4). At the same time, one of the pair of first conductive poles 211 or the pair of second conductive poles 212 is received in the insulative housing 1 to electrically connect with the pair of conductive terminals 15. If the user wants to change another of the pair of first conductive poles 211 or the pair of second conductive poles 212, the user just presses the two opposite button bodies 222 again. At the same time, the clamping bodies 221 of the clamping elements 22 will approach each other and the clamping bodies 221 will be separated from the notch 113. Then the user can change another of the pair of first conductive poles 211 or the pair of second conductive poles 212 (as shown in FIGS. 4 and 6).

Figure 6:
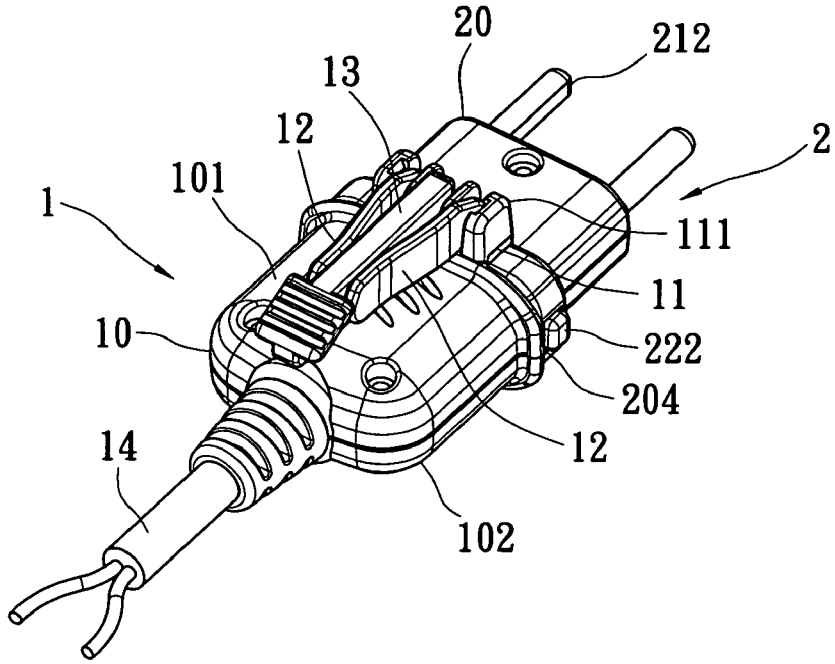
FIG. 6 is a perspective view of the power plug according to the first embodiment of the present invention.
Figure 7:
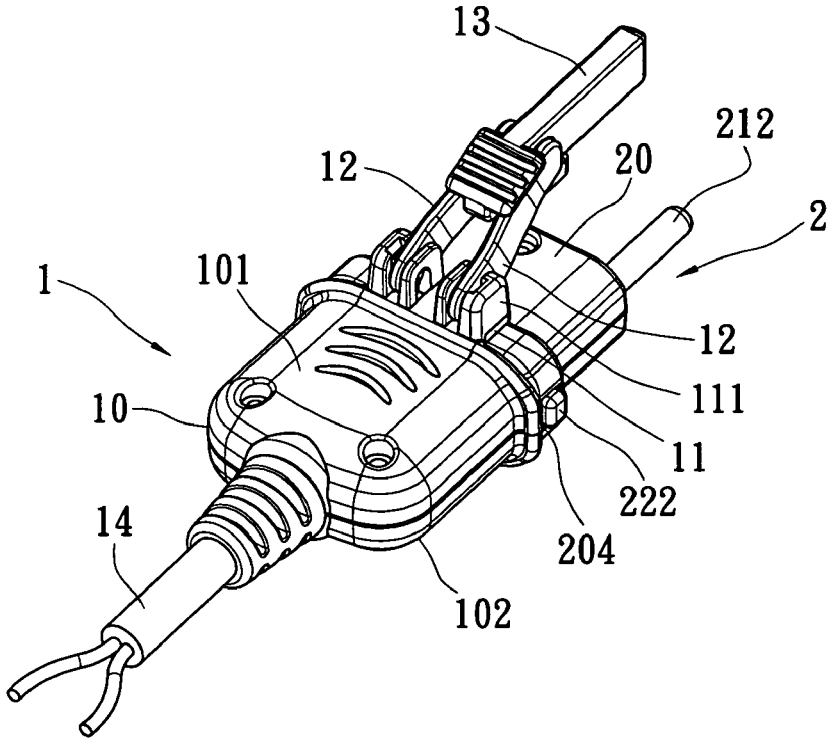
FIG. 7 is a perspective view of the power plug according to the second embodiment of the present invention.

When the present invention is used in a country that uses the third pole (grounding pole), the user can rotate the grounding pole 13 relative to the two rotatable elements 12 to parallel with the pair of first conductive poles 211 or the pair of second conductive poles 212 (as shown in FIG. 7), or pull back the grounding pole 13 relative to the two rotatable elements 12 (as shown in FIG. 4 or FIG. 6).

Figure 8:
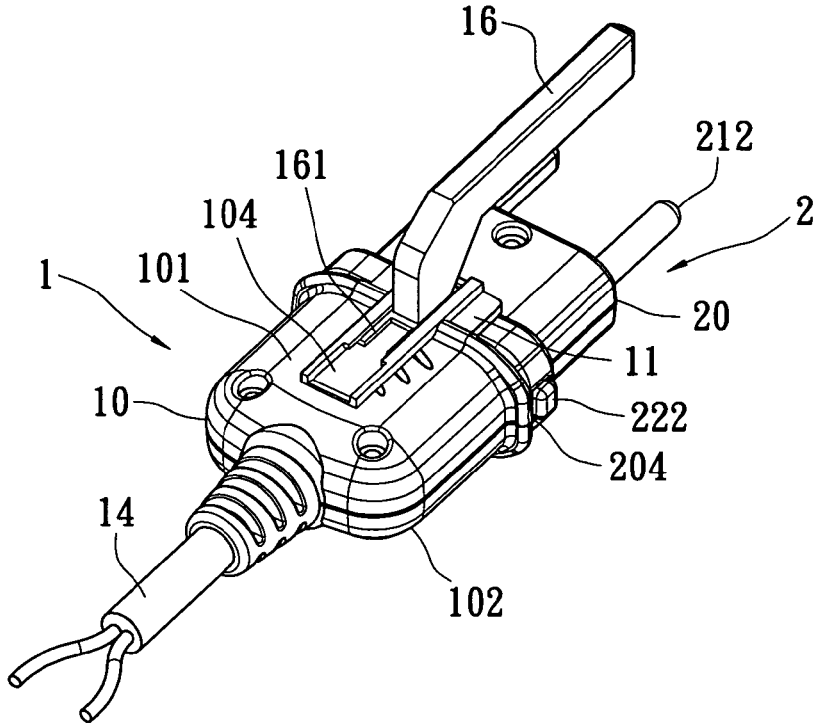
FIG. 8 is a perspective view of the power plug according to the third embodiment of the present invention.
Figure 9:
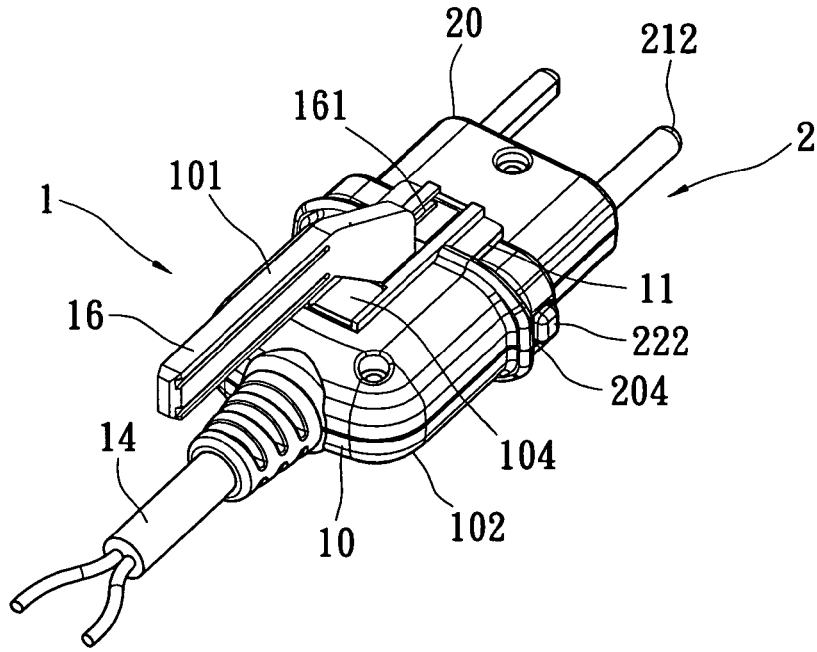
FIG. 9 is a perspective view of the power plug according to the third embodiment of the present invention.

FIGS. 8 and 9 show a perspective view of the power plug according to the third embodiment of the present invention. The insulative housing 10 has an embedded groove 104 parallel to the pair of first conductive poles 211 and the pair of second conductive poles 212. The first grounding pole 16 has an embedded body 161 disposed at an end side thereof for embedding the grounding pole 16 into the embedded groove 104 in the same direction as that of the pair of second conductive poles 212 (as shown in FIG. 8), or in the same direction as that of the pair of second conductive poles 212 (as shown in FIG. 9).

Figure 15:
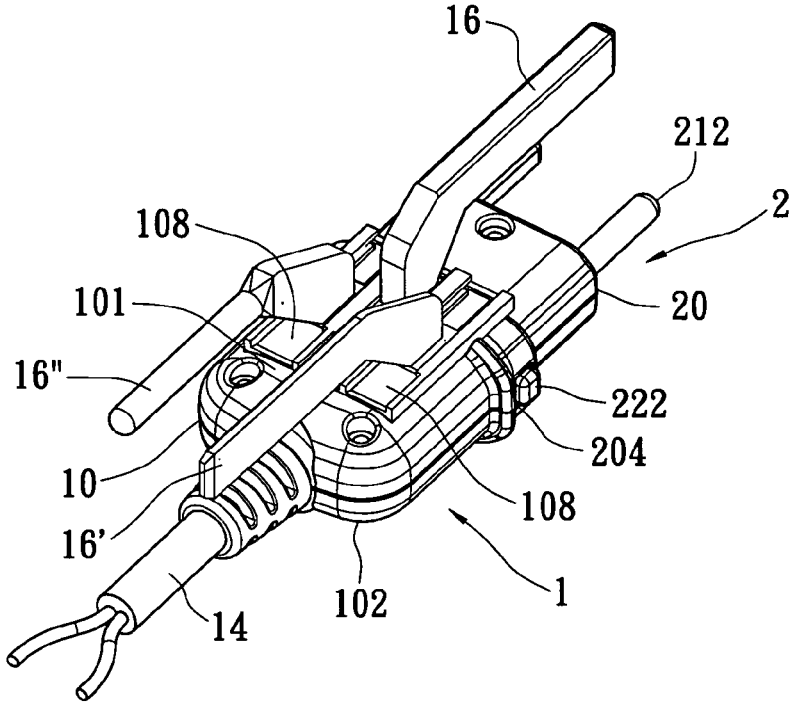
FIG. 15 is a perspective view of the power plug according to the ninth embodiment of the present invention.

FIG. 15 shows a perspective view of the power plug according to the ninth embodiment of the present invention. The insulative housing 10 has two embedded grooves 108 for receiving a second grounding pole 16' and a third grounding pole 16" as a spare.

Figure 10:
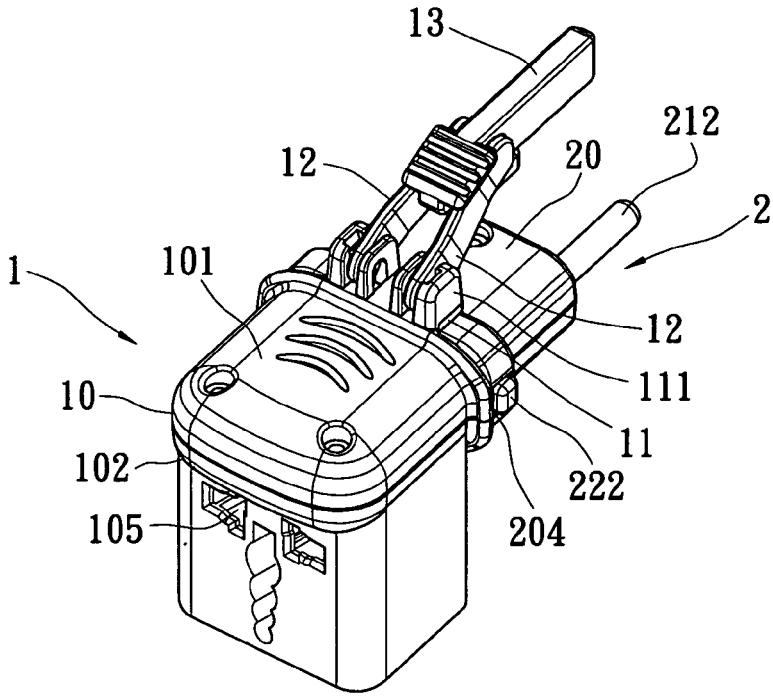
FIG. 10 is a perspective view of the power plug according to the fourth embodiment of the present invention.

FIG. 10 shows a perspective view of the power plug according to the fourth embodiment of the present invention. The insulative housing 10 has two socket holes 105 formed at a side thereof to replace the power source set 14. The two socket holes 105 are electrically connected to the conductive terminal 15.

Figure 11:
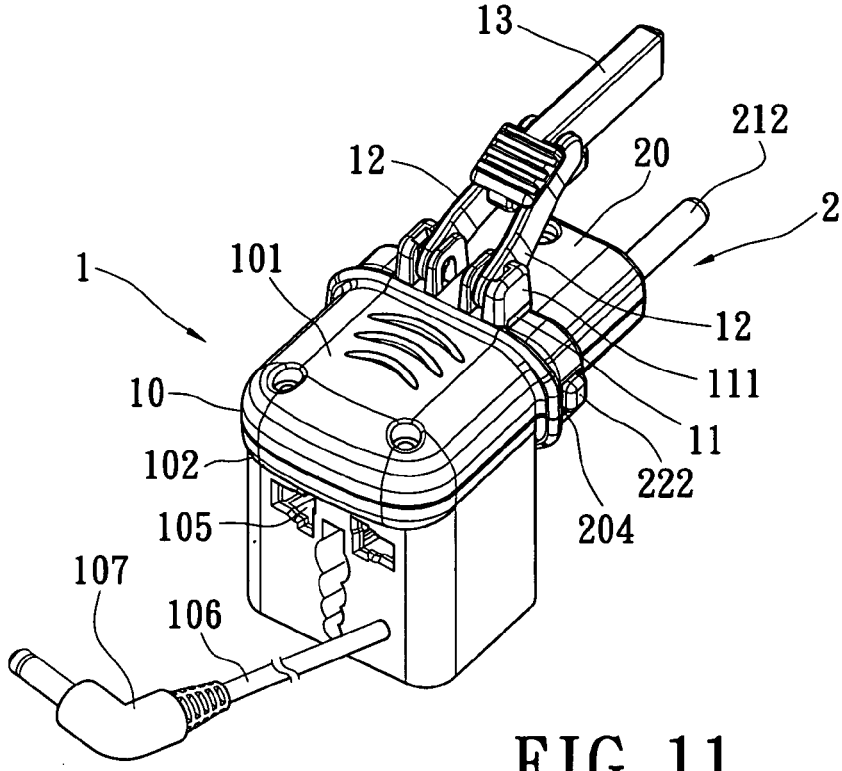
FIG. 11 is a perspective view of the power plug according to the fifth embodiment of the present invention.

FIG. 11 shows a perspective view of the power plug according to the fifth embodiment of the present invention. The insulative housing 10 further includes two socket holes 105 and a guiding wire 106.

Figure 12:
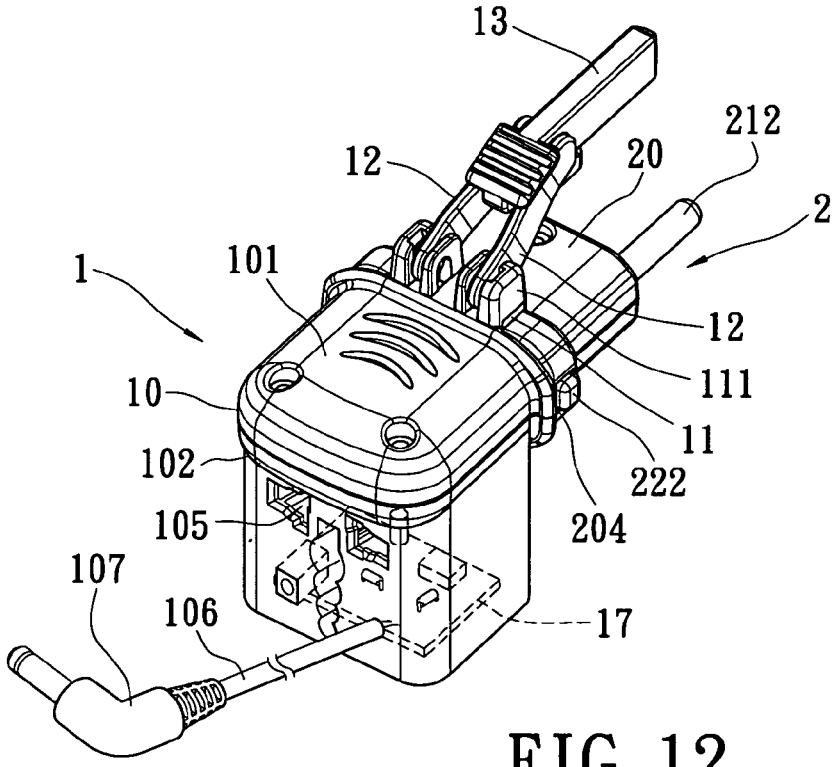
FIG. 12 is a perspective view of the power plug according to the sixth embodiment of the present invention.
Figure 14:
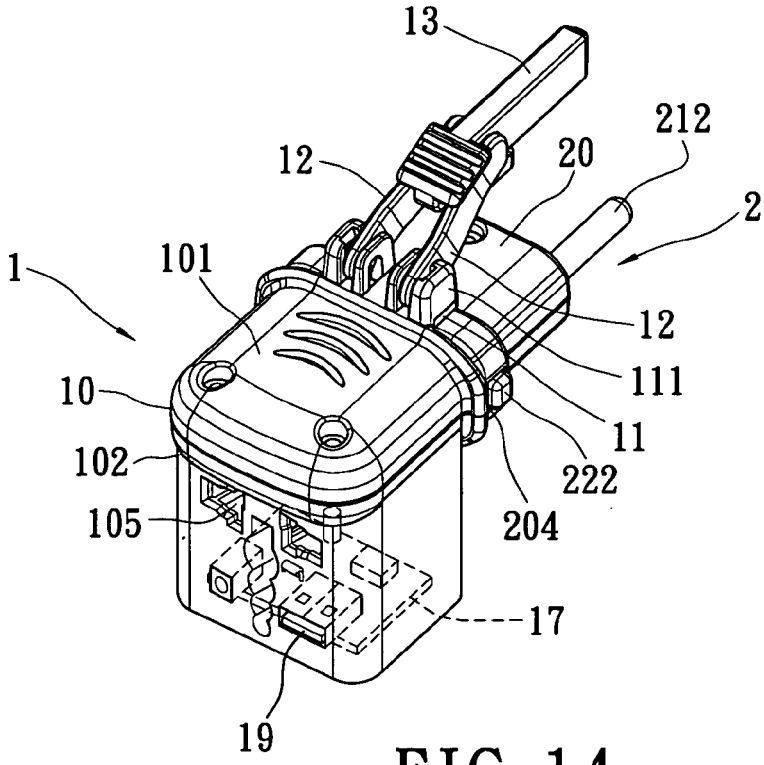
FIG. 14 is a perspective view of the power plug according to the eighth embodiment of the present invention.

FIG. 12 shows a perspective view of the power plug according to the sixth embodiment of the present invention. The connected unit 1 further includes a battery charger unit 17 disposed in the insulative housing 10 and electrically connected to the conductive terminal 15 for supplying power to the battery charger unit 17. The connected unit 1 further includes a guiding wire 106 connected to the battery charger unit 17, and a connector 107 connected to the guiding wire 106 for supplying power to an electric equipment or a battery charger. Furthermore, the battery charger unit 17 can be connected to a USB connector (as shown in FIG. 14).

Figure 13:
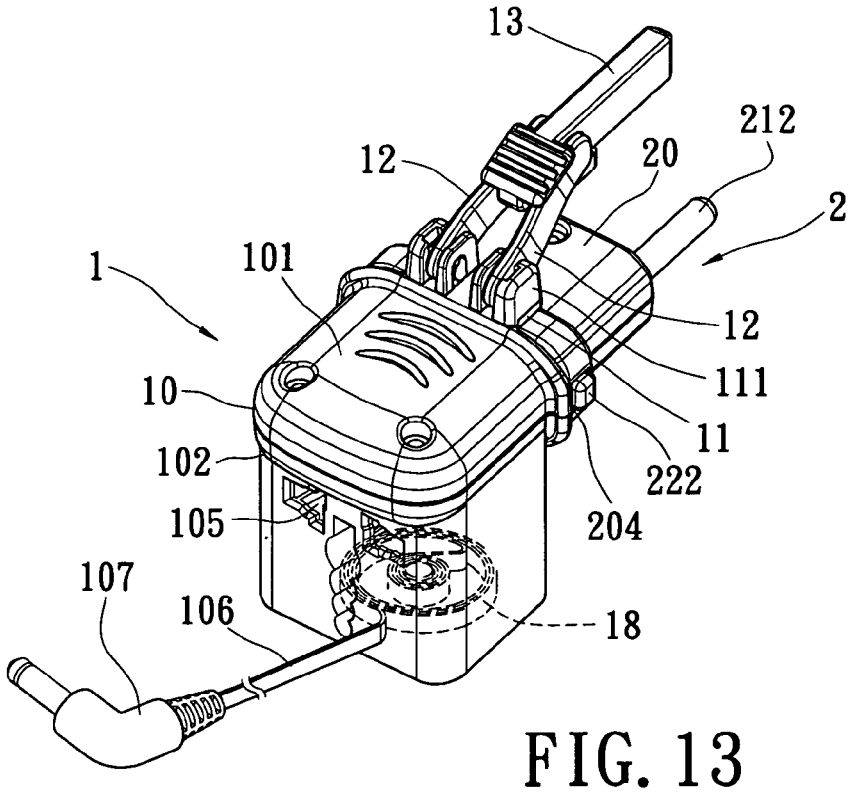
FIG. 13 is a perspective view of the power plug according to the seventh embodiment of the present invention.

FIG. 13 shows a perspective view of the power plug according to the seventh embodiment of the present invention. The connected unit 1 further includes a coil device 18 disposed in the insulative housing 10, and a guiding wire 106 coiled in the coil device 18.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A power plug comprising:

a connected unit having an insulative housing with a terminal opening, the insulative housing has a conductive terminal disposed therein;

an assembled unit having an insulative casing and a movable body reversibly insertably received in the insulative casing, the movable body having a first conductive pole extending from one end thereof and a second conductive pole extending from an opposing end, the assembled unit being installed in the terminal opening of the connected unit, the movable body being selectively inserted in said insulative casing to enable a selected one of the first conductive pole and the second conductive pole to be electrically connected to the conductive terminal, and the other of the second conductive pole and the first conductive pole being projected outside the insulative casing; and a clamping mechanism disposed between the connected unit and the assembled unit.

2. The power plug as claimed in claim 1, wherein the clamping mechanism includes two clamping grooves formed on the connected unit and two clamping elements disposed on the assembled unit, the two clamping elements are received in the insulative casing, each of the two clamping elements has two camping bodies respectively formed at two sides thereof and projected outside the insulative casing for embedding in the two clamping grooves.

3. The power plug as claimed in claim 1, wherein the insulative housing of the connected unit further includes a pivoted seat disposed thereon, a rotatable element with one side pivoted to the pivoted seat, and a grounding pole pivoted to another side of the rotatable element for rotating relative to the rotatable element.

4. The power plug as claimed in claim 1, wherein the insulative housing further includes an embedded groove for receiving an embedded body of the grounding pole in a same direction as that of the first conductive pole and the second conductive pole, or in an inverse direction as that of the first conductive pole and the second conductive pole.

5. The power plug as claimed in claim 1, wherein the insulative housing further includes two embedded grooves for receiving two kinds of grounding poles, respectively.

6. The power plug as claimed in claim 1, wherein the conductive terminal is electrically connected to a power source set.

7. The power plug as claimed in claim 1, wherein the connected unit further includes a battery charger unit received in the insulative housing and connected to the conductive terminal, and a connector connected to the battery charger unit.

8. The power plug as claimed in claim 1, wherein the connected unit further includes a coil device with a guiding wire coiled therein, and the guiding wire is connected to the conductive terminal.

9. The power plug as claimed in claim 2, wherein the insulative casing has two openings respectively formed at a top side and a bottom side thereof, and two holes respectively formed at a front side and a rear side thereof, the projected bodies projected outside the corresponding openings, one of the first conductive pole and the second conductive pole projected outside the corresponding hole.

10. The power plug as claimed in claim 2, wherein the insulative casing has a guiding groove formed at an inner wall thereof, the guiding groove has a guiding direction cross to a movable direction of the movable body, the two clamping elements embedded into the corresponding two guiding grooves, the insulative casing further includes openings for exposure of the corresponding clamping bodies, and the openings are communicated with the guiding groove.

11. The power plug as claimed in claim 2, wherein each of the two clamping elements has a button body projected therefrom, the insulative casing has two through holes formed thereon for exposure of the corresponding button bodies, the clamping mechanism further includes two elastic elements disposed between the two clamping elements.

12. The power plug as claimed in claim 2, wherein the two clamping elements with two inner sides are used to fix the movable body.

13. A power plug comprising:

a connected unit having an insulative housing with a terminal opening, the insulative housing having a conductive terminal disposed therein;

an assembled unit having an insulative casing and a movable body movably received in the insulative casing, the movable body having a first conductive pole and a second conductive pole, the assembled unit being installed in the terminal opening of the connected unit, one of the first conductive pole and the second conductive pole being electrically connected to the conductive terminal, and the other of the second conductive pole and the first conductive pole being projected outside the insulative casing; and a clamping mechanism disposed between the connected unit and the assembled unit, the clamping mechanism includes two clamping grooves formed on the connected unit and two clamping elements disposed on the assembled unit, the insulative housing having two projected bodies respectively projected from a top side and a bottom side thereof, and the two clamping grooves being respectively formed at two opposite inner sides of the two projected bodies for receiving the two clamping elements.

14. The power plug as claimed in claim 13, wherein each of the clamping grooves has a notch.

15. A power plug comprising:

a connected unit having an insulative housing with a terminal opening, the insulative housing has a conductive terminal disposed therein, the connected unit a battery charger unit received in the insulative housing and connected to the conductive terminal, a guiding wire connected to the battery charger unit, and a connector connected to the guiding wire;

an assembled unit having an insulative casing and a movable body movably received in the insulative casing, the movable body having a first conductive pole and a second conductive pole, the assembled unit being installed in the terminal opening of the connected unit, one of the first conductive pole and the second conductive pole being electrically connected to the conductive terminal, and another of the second conductive pole and the first conductive pole being projected outside the insulative casing; and a clamping mechanism disposed between the connected unit and the assembled unit.

* * * * *